US006164355A

United States Patent [19]

Boucherie

[11] Patent Number: 6,164,355

[45] Date of Patent: Dec. 26, 2000

[54] BRUSH FINISHING MACHINE

[75] Inventor: Bart Gerard Boucherie, Izegem, Belgium

[73] Assignee: G. B. Boucherie N.V., Izegem, Belgium

[21] Appl. No.: 09/139,661

[22] Filed: Aug. 25, 1998

[30] Foreign Application Priority Data

Aug. 26, 1997 [DE] Germany ..... 297 15 321 U

[51] Int. Cl.[7] ..... B32B 31/20; B44C 3/08

[52] U.S. Cl. ..... 156/358; 156/361; 156/542; 156/583.5

[58] Field of Search ..... 156/540, 541, 156/542, 583, 583.5, 357, 358, 359, 361, 362, 368, 288, 289, 324, 350

[56] References Cited

U.S. PATENT DOCUMENTS 3,813,268 5/1974 Kerwin ..... 156/247

4,287,016 9/1981 Kerwin et al. ..... 156/497

4,637,660 1/1987 Weihrauch ..... 300/21

*Primary Examiner*—Laura Edwards

*Assistant Examiner*—George R. Koch, III

*Attorney, Agent, or Firm*—Nixon Peabody LLP; Stuart J. Friedman

[57] ABSTRACT

Provided is a brush finishing machine including, arranged along an endless chain, finishing stations comprising at least one stamping press for marking the brush handles with decals transferred for application thereto from a foil advanced by an indexing mechanism provided upstream of the brush handles, the endless chain carrying at each chain link two brush bodies held spaced away from each other at the chain link, and the stamping press comprising two stamping dies located opposite the brush handles.

8 Claims, 3 Drawing Sheets

BRUSH FINISHING MACHINE

The invention relates to a brush finishing machine including, arranged along an endless chain, finishing stations comprising at least one stamping press for marking the brush handles with decals transferred for application thereto from a foil advanced by an indexing mechanism provided upstream of the brush handles.

To double the output of such a brush finishing machine for the same timing speed two brush bodies may be held at each link of the endless chain. For stamping the brush handles with decals two separate stamping presses are then needed, however, the first of which stamps one of a pair of brush handles on a chain link and the second stamps the other brush handle at an adjacent chain link so that the dies of both presses encounter unused surface areas of the foil. Due to the second press being needed, an additional station is added to the brush finishing machine which, on the one hand, increases the length of the endless chain, thus resulting in the machine as a whole taking up more room and, on the other, the expense involved is increased considerably.

The invention provides a brush finishing machine of the aforementioned kind permitting marking of both brush handles of a pair on one and the same chain link of the endless chain with but a single stamping press. In accordance with the invention the endless chain carries at each chain link two brush bodies held spaced away from each other at the chain link, and the press comprises two dies located opposite the brush handles. Since both dies belong to the same press working only the brush handles on a single chain link, the length of the endless chain remains unchanged although now each chain link carries two brush bodies.

Preferably the indexing mechanism for the timed incremental advance of the foil permits controlling the indexing width in advancing the foil.

To prevent the second die of the press from encountering surface areas of the foil already used by the first die, several solutions are proposed.

In accordance with a first solution a detection means is provided which activates the indexing mechanism whenever the second die is located opposite a used surface area of the foil to produce such an advance that an unused surface area of the foil is located opposite the two dies. In such a solution the indexing width in advancing the foil is not constant, it instead being variable between two limits. The first limit of the foil advance corresponds to the width of a decal on the foil; the second limit of the foil advance corresponds to a multiple of the first limit of the foil advance as dictated by the spacing of the dies from each other or the length of the foil section between the dies.

In accordance with a second solution the indexing width of the foil advance is set constant to a single value corresponding to roughly twice the decal width on the foil so that the second die encounters surface areas of the foil unused and skipped by the first die. In this embodiment the foil advance is simplified since it works with a constant indexing width.

In accordance with one aspect applicable to both solutions the foil forms between the dies a loop, the length of which including the foil sections opposite the dies corresponds to a multiple of the width of the decals on the foil. By this aspect wastage in the foil surface area is also avoided even when the spacing of the dies from each other fails to correspond to a multiple of the width of the decals on the foil.

Further features and advantages of the invention read from the following description and the drawing to which reference is made and in which.

Figure 1:
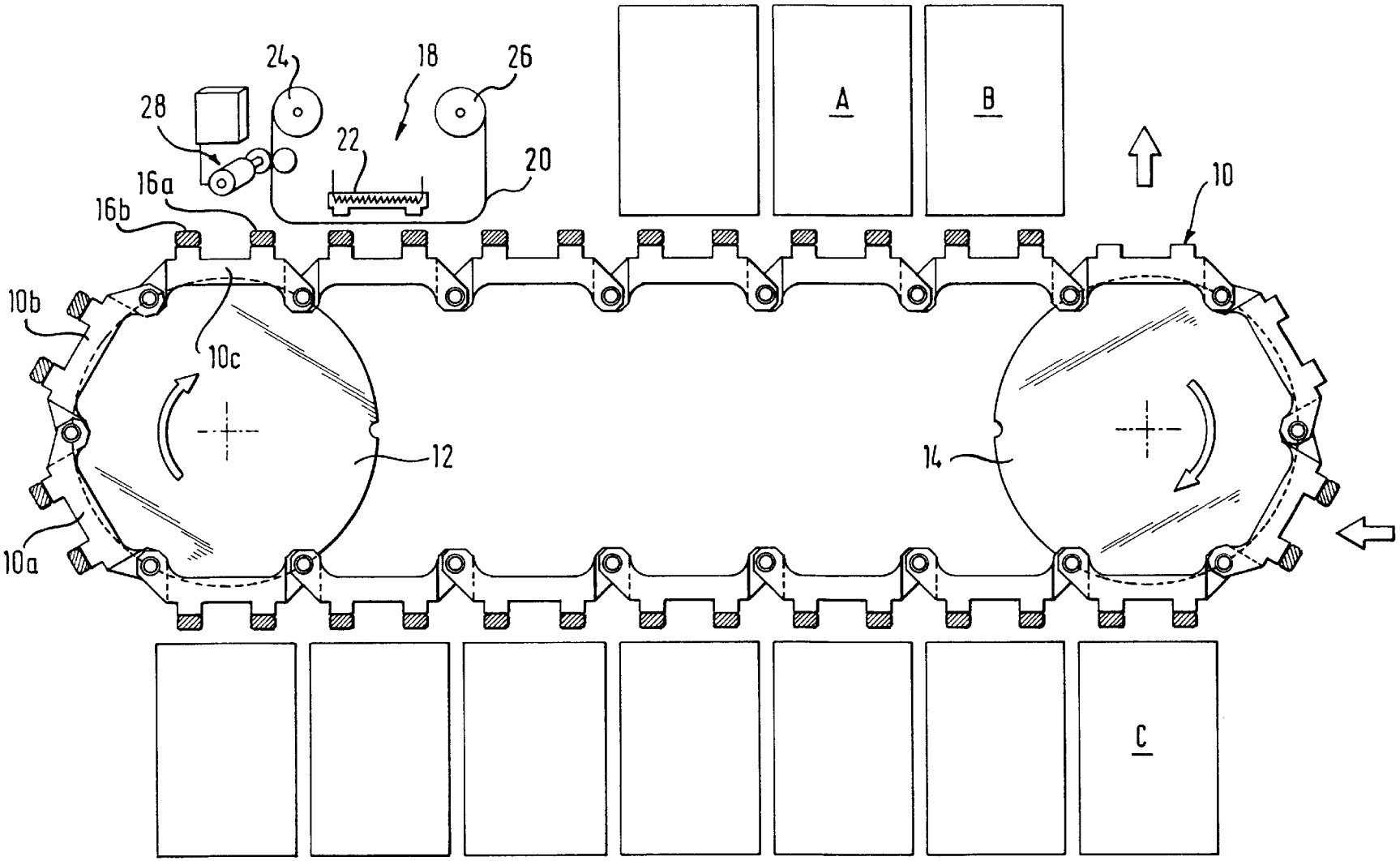
FIG. 1 is a schematic illustration of a brush finishing machine including finishing stations arranged along an endless chain.
Figure 2:
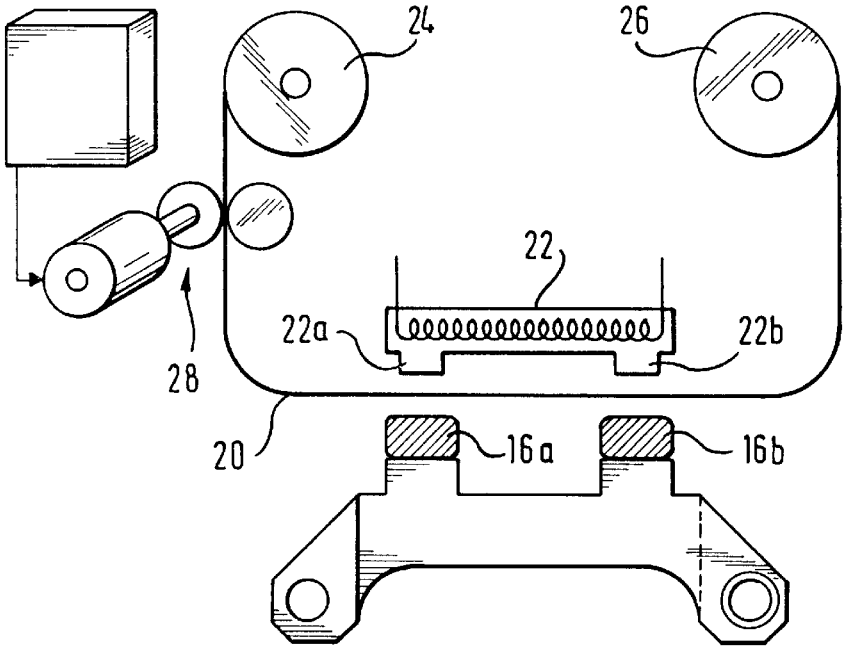
FIG. 2 is an illustration of a first embodiment of a finishing station, in which brush handles are marked by means of a stamping press.

Referring now to FIG. 1 there is illustrated schematically a brush finishing machine in which an endless chain 10 is indexed past a plurality of finishing stations A, B, C . . . by sprocket wheels 12, 14. Each chain link 10*a*, 10*b*, 10*c* . . . carries two brush bodies 16*a*, 16*b*, the brush handles of which are to be stamped with decals in one of the finishing stations, a stamping station 18, these decals being applied to a foil, more particularly a hot stamping foil 20. The stamping station 18 contains a press 22 having two dies 22*a*, 22*b* located opposite the brush handles of the two brush bodies 16*a*, 16*b*. The hot stamping foil 20 is unwound from a reel 24; the used foil 20 is wound on a spool 26. For advancing the foil 20 an indexing mechanism 28 is provided.

Figure 3:
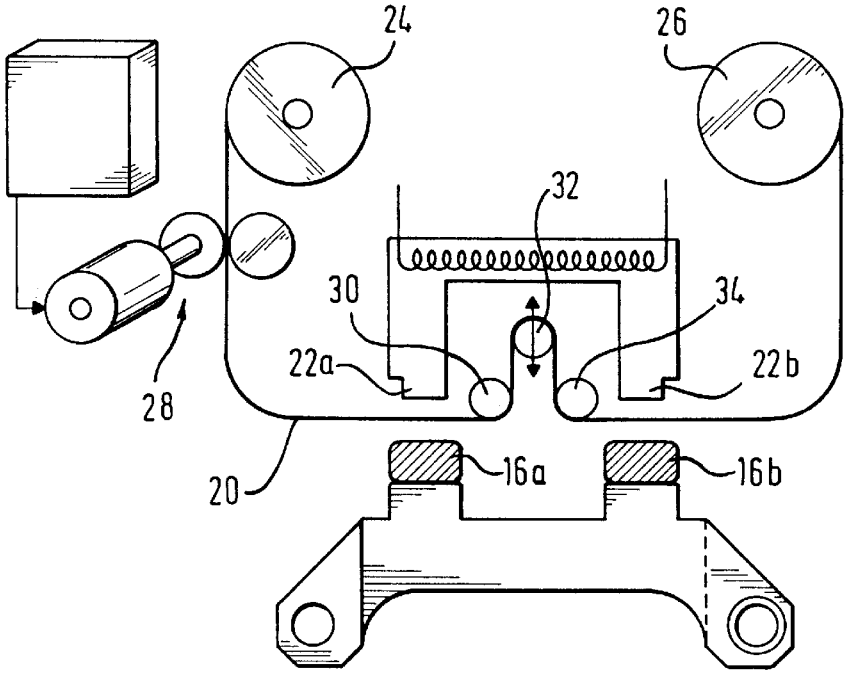
FIG. 3 is an illustration of a second embodiment of a finishing station, in which brush handles are marked by means of a stamping press.

Referring now to FIG. 3 there is illustrated an embodiment in which the foil 20 is deflected between the dies 22*a*, 22*b* by three guide pulleys 30, 32, 34, the middle pulley 32 of which is adjustable so that a foil loop of adjustable length forms between the dies 22*a*, 22*b*.

To prevent the second die encountering surface areas of the foil 20 already used by the first die, several solutions are possible which will now be discussed with reference to the sketches in the FIGS. 4*a* to 4*d*.

Figure 4A:
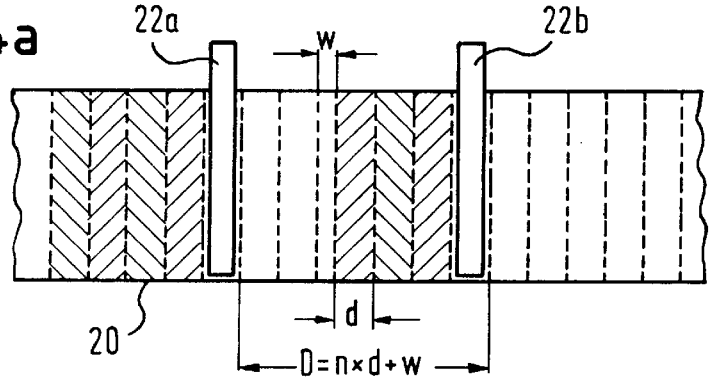
FIGS. 4*a, b, c* and *d* are sketches assisting in explaining several solutions in ensuring that both dies of the press encounter unused surface areas of a marking foil.
Figure 4B:
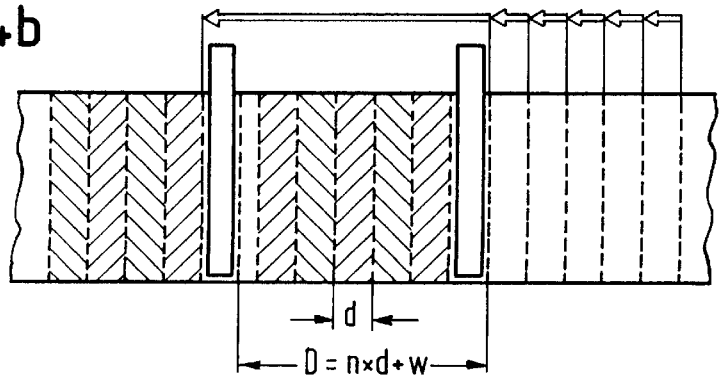

The dies 22*a*, 22*b* are spaced away from each other by a distance which must not agree with a multiple of the width d of the decals on the foil 20. In FIGS. 4*a* and 4*b* it is assumed that this spacing D between the dies differs by the dimension w from an integer multiple of the width d of the decals.

Once a specific number of decals has been transferred from the fresh foil 20 by the first stamping die 22*a*, the second stamping die 22*b* encounters for the first time a surface area of foil 20 which has already been used by the first die 22*a*, this being evident from FIG. 4*b*. Whilst, previously, the foil 20 was indexed in widths corresponding to the width d of the decals on the foil 20, now a greater advance according to an integer multiple of the width d is needed, corresponding to the length of the foil section upstream of the two dies 22*a*, 22*b*. These differing values in indexing the foil are indicated by the arrows in FIG. 4*b*.

Figure 4C:
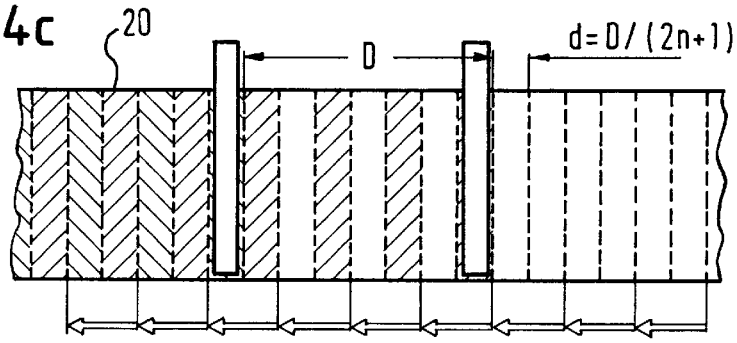
Figure 4D:
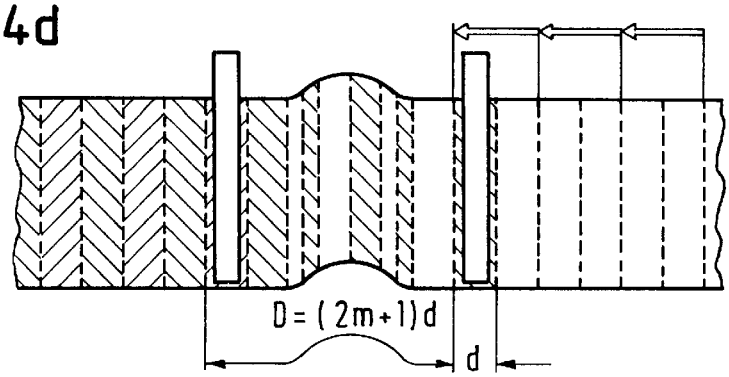

Referring now to FIG. 4*c* there is illustrated a solution in which the foil 20 is advanced on each stamping cycle by a constant amount roughly equalling twice the width of the decals. The first stamping die 22*a* thus skips every second decal which then remains available for use by the second die 22*b*.

The aspect of the invention as shown in FIG. 3 enables full use to be made of the foil surface area even when—as evident from FIGS. 4*a* and 4*b*—the spacing between the dies 22*a*, 22*b* fails to equal an integer multiple of the width d of the decals. This is achieved by a suitable setting of the foil loop formed by deflection of the foil 20 by means of pulleys 30, 32 and 34. As evident from FIG. 4*d* use is made of the same principle as shown in FIG. 4*c*, i.e. working with a constant indexing width in foil advance.

Suitable systems for open and closed loop control of foil indexing are available in the art which are not described in the present, it being particularly of advantage to use optical detection means for sensing the used foil surface area and closed-loop controls to ensure that the decal sequence on the foil 20 remains synchronized with the operating sequence of the stamping press.

What is claimed is:

1. A brush finishing machine including, arranged along an endless chain, finishing stations comprising at least one stamping press for marking the brush handles with decals transferred for application thereto from a foil advanced by an indexing mechanism provided upstream of said brush handles, said endless chain carrying at each chain link two brush bodies held spaced away from each other at said chain link, and said stamping press comprising two similar stamping dies located next to each other on one side opposite said brush handles, each of said stamping dies being provided for pressing said foil on one of said brush handles.

2. A brush finishing machine as set forth in claim 1, wherein said indexing mechanism permits automatic controlling of the indexing width in advancing said foil during operation of said brush finishing machine.

3. The brush finishing machine as set forth in claim 1, wherein s aid foil is deflected between said dies.

4. The brush finishing machine as set forth in claim 3 wherein in that said foil forms between said dies a loop, the length of which including said foil sections opposite said dies corresponds to an integer multiple of said width (d) of said decals on said foil.

5. The brush finishing machine as set forth in claim 4, wherein said length of said loop including said foil sections opposite said dies corresponds to an odd multiple of said width of said decals on said foil.

6. A brush finishing machine including, arrayed along an endless chain, finishing stations comprising at least one stamping press for marking the brush handles with decals transferred for application thereto from a foil advanced by an indexing mechanism provided upstream of said brush handles, said endless chain carrying at each chain link two brush bodies held spaced away from each other at said chain link, said stamping press comprising two stamping dies located opposite said brush handles, said indexing mechanism permitting controlling an indexing width in advancing said foil, wherein a detection means is provided which activates said indexing mechanism whenever said second die is opposite a used surface area of said foil to produce such an advance that an unused surface area of said foil is located opposite said two dies.

7. A brush finishing machine including, arranged along an endless chain, finishing stations comprising at least one stamping press for marking the brush handles with decals transferred for application thereto from a foil advanced by an indexing mechanism provided upstream of said brush handles, said endless chain carrying at each chain link two brush bodies held spaced away from each other at said chain link, said stamping press comprising two stamping dies located opposite said brush handles, said indexing mechanism permitting controlling an indexing width in advancing said foil, wherein said indexing width in advancing said foil is variable between two limits, the first limit of which corresponds to the width of a decal on said foil and the second limit of which corresponds to an integer multiple of said first limit dictated by the spacing of said dies from each other or the length of the foil section between said dies.

8. A brush finishing machine including, arranged along an endless chain, finishing stations comprising at least one stamping press for marking the brush handles with decals transferred for application thereto from a foil advanced by an indexing mechanism provided upstream of said brush handles, said endless chain carrying at each chain link two brush bodies held spaced away from each other at said chain link, said stamping press comprising two stamping dies located opposite said brush handles, said indexing mechanism permitting controlling an indexing width in advancing said foil, wherein said indexing width of said foil advance is set to a constant value corresponding to roughly twice said decal width on said foil so that said second die encounters surface areas of said foil unused and skipped by said first die.

* * * * *